US005123186A

United States Patent [19]

Matushita et al.

[11] Patent Number: 5,123,186

[45] Date of Patent: Jun. 23, 1992

[54] SNOWBLOWER

[75] Inventors: Yorio Matushita; Yoshihisa Satou, both of Iwata, Japan

[73] Assignee: Yamaha Hatsudoki Kabushiki Kaisha, Shizuoka, Japan

[21] Appl. No.: 562,218

[22] Filed: Aug. 3, 1990

[30] Foreign Application Priority Data

Aug. 4, 1989 [JP] Japan ..... 1-201351

[51] Int. Cl.[5] ..... E01K 5/09

[52] U.S. Cl. ..... 37/251; 37/254; 37/257

[58] Field of Search ..... 37/249, 250, 251, 254, 37/255, 256, 257

[56] References Cited

U.S. PATENT DOCUMENTS

| | | | |
|---|---|---|---|
| 2,610,414 | 9/1952 | Vanvick | 37/251 |
| 3,043,028 | 7/1962 | Henry et al. | 37/250 |
| 3,295,232 | 1/1967 | Oglesby et al. | 37/257 X |
| 3,774,321 | 11/1973 | David | 37/257 X |

FOREIGN PATENT DOCUMENTS

| | | | |
|---|---|---|---|
| 671590 | 10/1963 | Canada | 37/251 |
| 180637 | 9/1962 | Sweden | 37/250 |

*Primary Examiner*—Randolph A. Reese
*Assistant Examiner*—Arlen L. Olsen
*Attorney, Agent, or Firm*—Ernest A. Beutler

[57] ABSTRACT

A snowblower arrangement having a scraper mechanism affixed to the ends of the auger for scraping snow and precluding its accumulation on the sidewalls of the auger housing.

8 Claims, 6 Drawing Sheets

SNOWBLOWER

BACKGROUND OF THE INVENTION

This invention relates to a snowblower and more particularly to an improved auger and housing arrangement therefore.

As is well known, most snowblowers include a forwardly positioned auger housing that has a frontwardly facing opening into which snow may pass as the snowblower is pressed into the snow. An auger is positioned within this housing and collects the snow and delivers it to a discharge opening positioned at the rear of the auger housing. This discharge opening receives the snow and delivers it to an impeller that then throws the snow away from the area being cleared. This type of device is well known and is quite successful in operation.

However, there are certain problems in connection with the handling of snow in this manner. Conventionally, the auger housing is defined by a pair of spaced sidewalls between which the auger extends. Generally, the auger is spaced inwardly from the sidewalls so as to provide adequate clearance for good operation. However, snow can become impacted in the gaps between the ends of the auger and the sidewalls of the auger housing. This snow will become tightly packed and turned to ice and can interfere with the successful operation of the device. That is, the ice can both resist rotation of the auger as well as impede forward movement.

It is, therefore, a principal object to this invention to provide an improved auger and housing arrangement for a snowblower wherein ice is not permitted to accumulate in the gaps between the ends of the auger and the sides of the housing.

It is a further object to this invention to provide an improved scraper arrangement for scraping any accumulated snow from the sidewalls of the auger housing so as to prevent ice formation and obstruction to operation.

It is a further object to this invention to provide a scraper arrangement for the sidewalls of an auger housing wherein the snow may be prevented from accumulating on the sidewalls of the auger housing and wherein removed snow will be taken away by the auger.

SUMMARY OF THE INVENTION

This invention is adapted to be embodied in a snowblower arrangement that comprises an auger housing defining a generally forwardly facing opening for receiving snow as the snowblower progresses through a body of snow. An auger is supported for rotation about an axis transversely disposed to the auger housing. The auger housing has at least one sidewall that extends generally perpendicularly to the forwardly facing opening and the auger housing has an end portion adjacent and spaced from the sidewall to define a gap. A scraper member is affixed for rotation with the auger for scraping snow or ice accumulated in the gap from the sidewall.

DETAILED DESCRIPTION OF THE PREFERRED EMBODIMENT OF THE INVENTION

Figure 1:
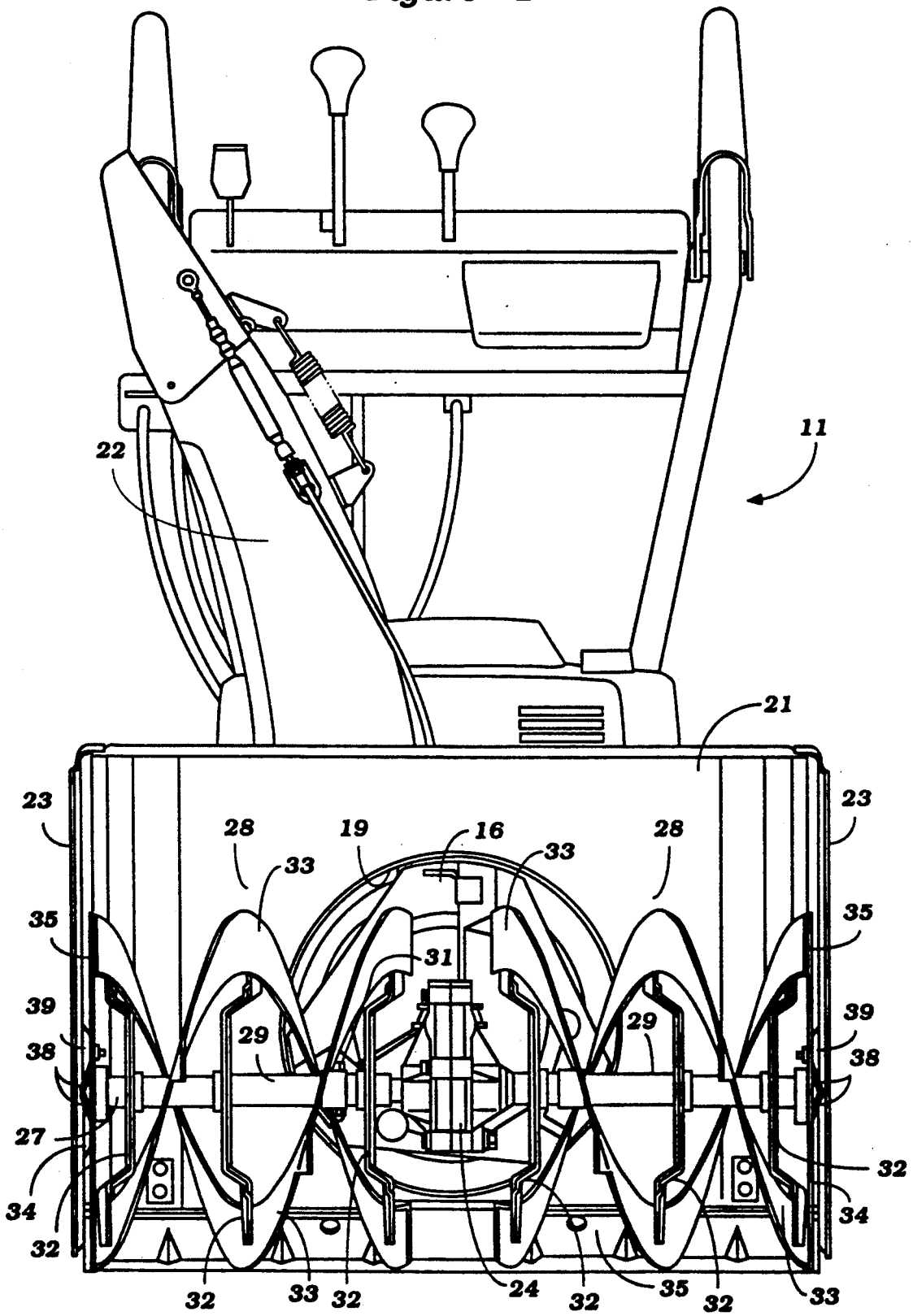
FIG. 1 is a front elevational view of a snowblower constructed in accordance with an embodiment of the invention.
Figure 2:
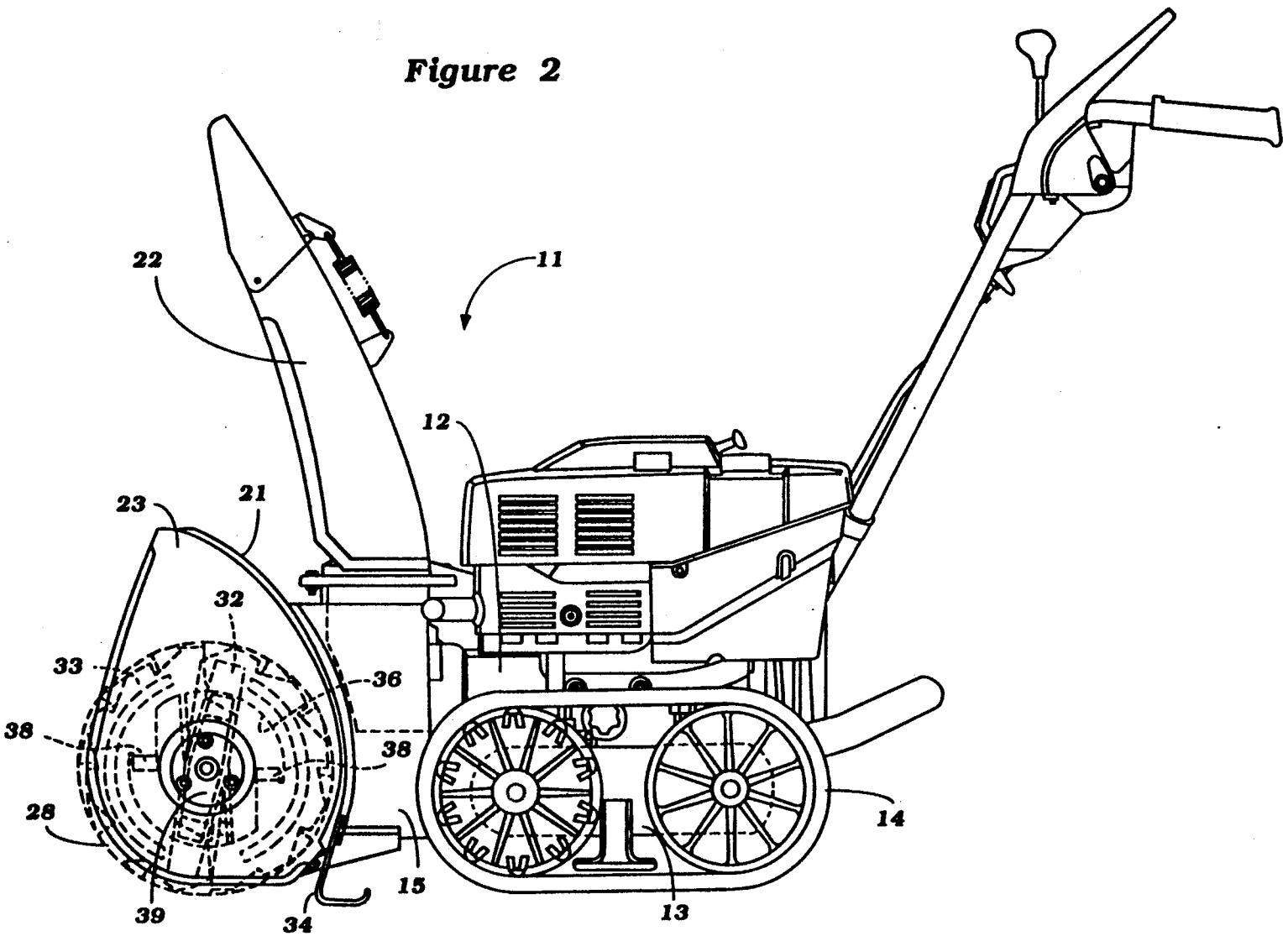
FIG. 2 is a side elevational view of the snowblower on a reduced scale.

Referring in detail initially to FIGS. 1 and 2, a snowblower constructed in accordance with an embodiment of the invention is identified generally by the reference numeral 11. The snowblower 11 includes a main body assembly 12 that contains a powering internal combustion engine and transmission, part of which is identified generally by the reference numeral 13 for driving a propelling track 14 and the auger and impelling assembly as to be described. This drive assembly may be of any known type, for example of the type shown in co-pending application Ser. No. 369748, entitled Power Transmitting Device for Working Machinery, filed Jun. 22, 1989 in the name of Masatoshi Takeshita and assigned to the assignee hereof. Since the invention deals with the auger portion of the snowblower, a description of that transmission assembly is not believed to be necessary to understand the construction and operation of the invention.

Figure 3:
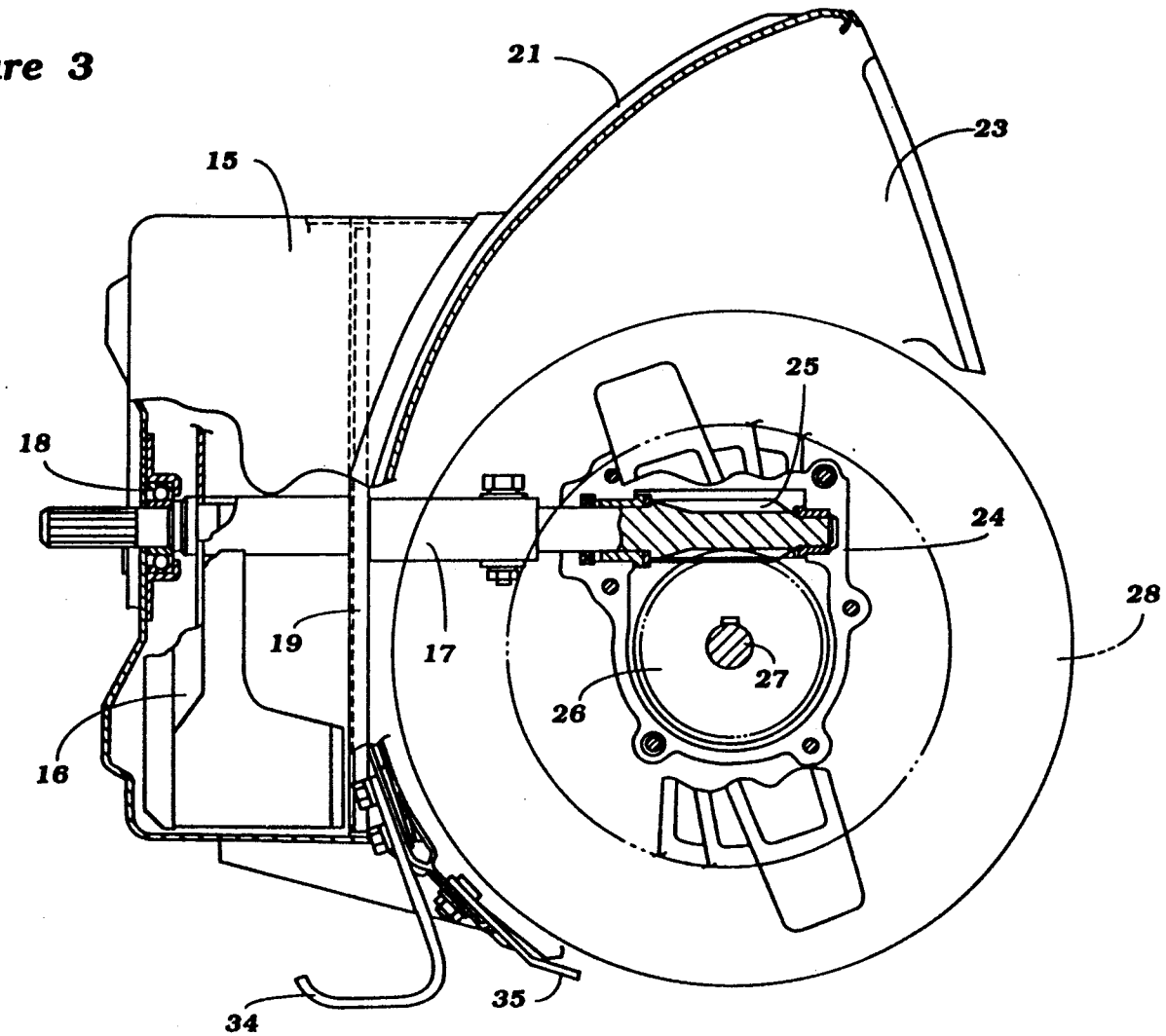
FIG. 3 is a side elevational view, with portions shown in cross section, of the auger and impeller portion of the snowblower.
Figure 4:
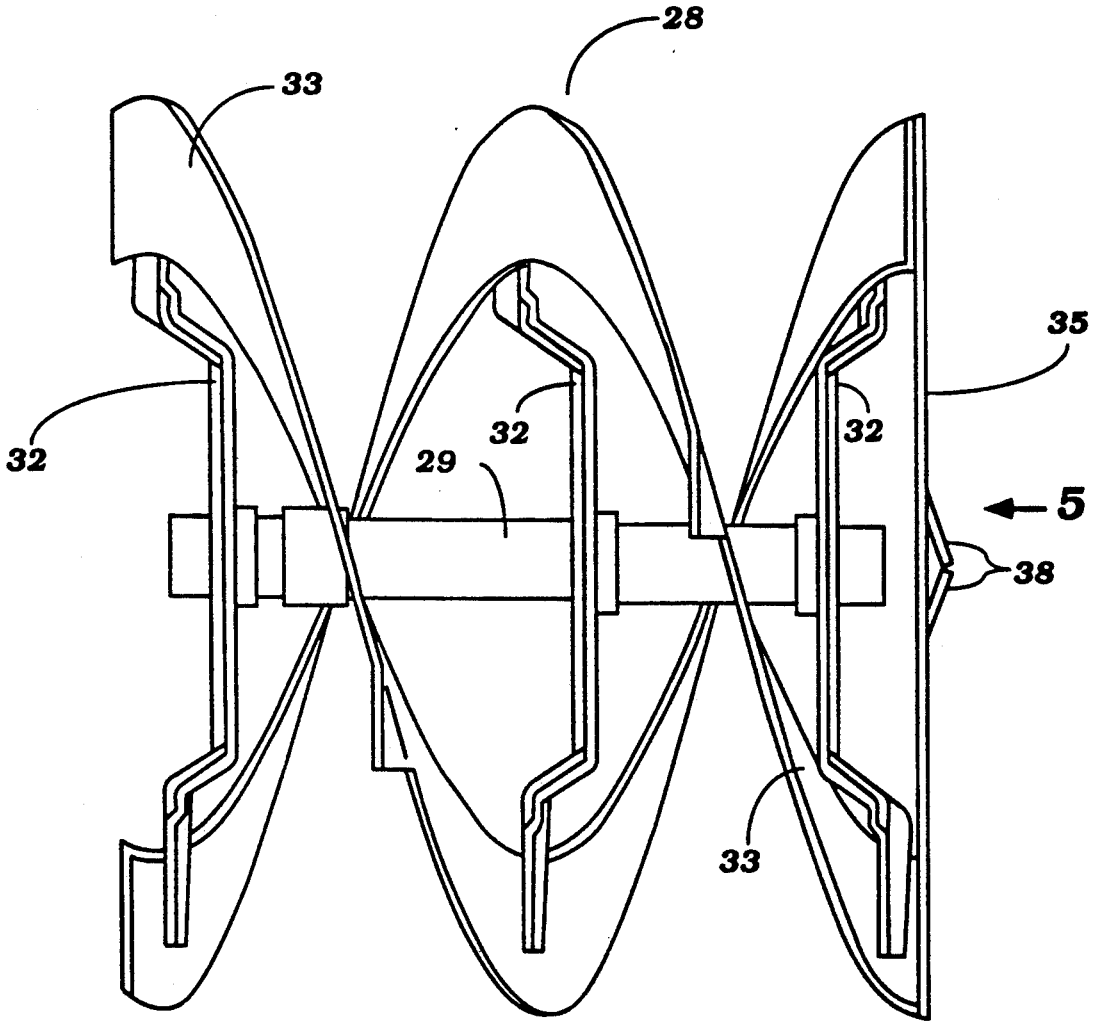
FIG. 4 is a front elevational view of a portion of the auger.
Figure 5:
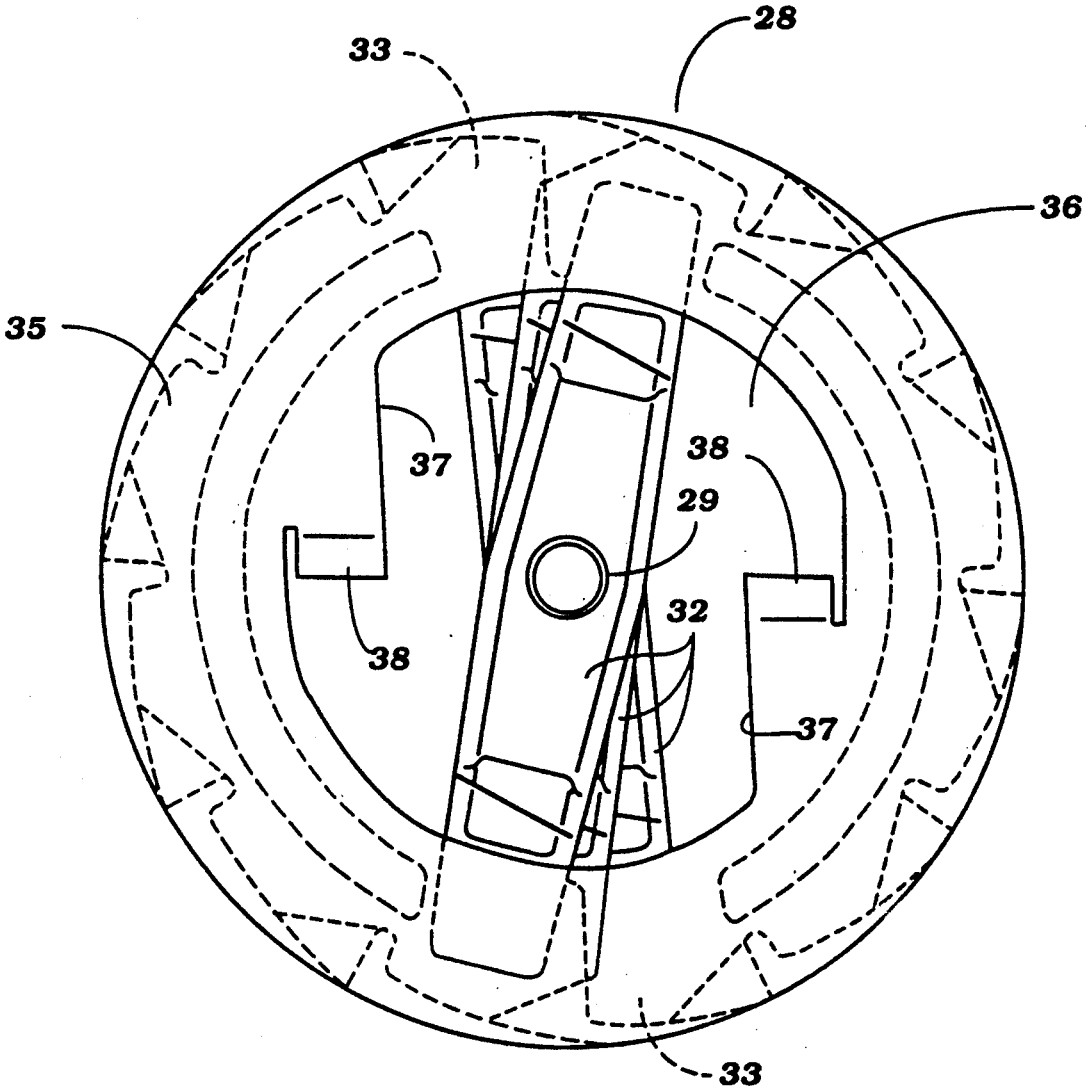
FIG. 5 is an end elevational view of the auger looking in the direction of the arrow 5 in FIG. 4.

Positioned forwardly of the main body assembly 12 is an impeller housing 15, as shown in most detail in FIG. 3, and which contains an impeller 16 which is driven from a drive shaft 17 and which is journalled in the impeller housing 15 by means of a bearing 18. The impeller housing 17 has an inlet opening 19 which is formed in the rear face of an auger housing assembly, indicated generally by the reference numeral 21 and to which snow is delivered by an auger to be described. The impeller 16 then throws the snow away from the area being cleared through a discharge chute 22 in a well-known manner.

The auger housing 21 has a generally curved rearward wall that is bounded by a pair of sidewalls 23 and which defines a forwardly facing opening to which snow is delivered as the snowblower 11 progresses in a forward direction.

A transmission casing 24 is positioned centrally of the auger housing 21 and journals the forward end of the shaft 17 and to which a worm gear 25 is affixed. The worm gear 25 meshes with a worm wheel 26 that is affixed, by means of a key, to an auger shaft 27. The auger shaft 27 extends transversely across the auger housing 21 and terminates inwardly of the sidewalls 23 thereof.

An auger assembly comprised of a pair of auger halves 28 of opposite hands, each has a sleeve portion 29 that encircles the auger shaft 27 is affixed to the auger shaft 27 in a suitable manner, for example by means of cotter keys or shear pins or the like. Affixed to the tubular member 29 by means of spider assemblies 32 are the respective augers 33.

Figure 6:
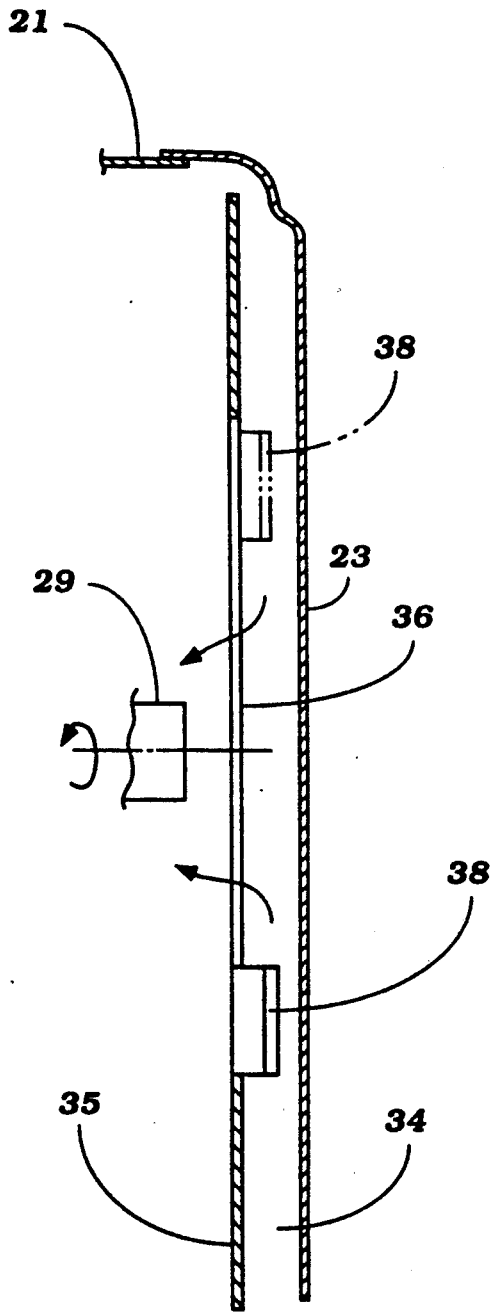
FIG. 6 is an enlarged cross sectional view showing the cooperation of the end of the auger with the sidewall of the auger housing.

Rearwardly of the auger assemblies 28 there is provided a skid plate 34 that supports the forward portion of the snowblower and a scraper blade 35 that cooperates with auger 28 in a well-known manner. It should be noted that the sidewalls 23 are spaced transversely outwardly from the ends of the auger assemblies 28 so that there is a gap 34 (FIGS. 1 and 6) in this area. With conventional snowblowers, snow may accumulate in this gap 34 and will eventually pack up and turn to ice. This impedes the rotation of the auger assemblies 28 and also the movement of the snowblower 11 forwardly through the snow.

In order to prevent this problem, a pair of endplates 35 are affixed, respectively, to the ends of the auger units 28 adjacent to the sidewalls 23 and the gaps 34. The plates 35 are generally cylindrical but define a central opening 36. The plate 35 has a pair of scrape portions 37 that extend into the opening 36 and which have offset scraper ends 38 which may be formed like tabs and which extend immediately adjacent the sidewall 23 as may be best seen in FIG. 6. The scraper blades 38 are, however, spaced slightly away from the sidewalls 23 for clearance purposes and to ensure that there will not be any direct contact. The scraper blades 38 will, however, engage any snow that tends to accumulate on the sidewalls 23 within the gap 34 and scrape this snow off. The snow then moves to the opening 36 and flows inwardly to be caught by the augers 33 and move centrally to the discharge opening 19 so as to be thrown away by the impeller. As a result, the construction is extremely effective in removing snow and also preventing any impediment to this operation as caused by ice which might have otherwise accumulated in the gaps 34.

It should be noted that there are provided sidebearings 39 that are disposed and supported from the sidewalls 23 for journalling the outer ends of the auger drive shaft 27. However, this construction is such that the scraper blades 38 will not interfere with the bearing relationship.

It is to be understood that the foregoing description is that of a preferred embodiment of the invention and that various changes and modifications may be made without departing from the spirit and scope of the invention, as defined by the appended claims.

We claim:

1. A snow blower arrangement comprising an auger housing defining a generally forwardly facing opening for receiving snow as said snow blower progresses through a body of snow, an auger supported for rotation about an axis disposed transversely to said auger housing, said auger housing having at least one sidewall extending generally perpendicularly to said forwardly facing opening, said auger having an end portion adjacent and spaced from said sidewall to define a gap there between, and scraper means affixed for rotation with said auger and having a cutting tip spaced radially inwardly from the outer periphery of said auger, said tip facing said sidewall and juxtaposed to said sidewall for scraping snow accumulating within said gap from said sidewall.

2. A snow blower arrangement as set forth in claim 1 wherein the scraper means has a plurality of cutting tips.

3. A snowblower arrangement as set forth in claim 2 wherein the cutting tips are all formed from a common annular member affixed to the end of the auger.

4. A snowblower arrangement as set forth in claim 1 wherein the scraper means delivers the snow scraped from the sidewalls to the auger for delivery away therefrom.

5. A snowblower arrangement as set forth in claim 4 wherein the snow is delivered centrally to the auger by the scraper means.

6. A snow blower arrangement as set forth in claim 5 wherein the scraper means has a plurality of cutting tips.

7. A snowblower arrangement as set forth in claim 6 wherein the cutting tips are all formed from a common annular member affixed to the end of the auger.

8. A snowblower arrangement as set forth in claim 7 wherein there are a pair of sidewalls and the auger has each of its ends disposed adjacent to one of the sidewalls and defining a gap there between with the scraper means affixed to each end of the auger for scraping snow from the adjacent sidewall.

* * * * *

UNITED STATES PATENT AND TRADEMARK OFFICE

CERTIFICATE OF CORRECTION

PATENT NO. : 5,123,186

DATED : June 23, 1992

INVENTOR(S) : Matushita, et al.

It is certified that error appears in the above-indentified patent and that said Letters Patent is hereby corrected as shown below:

On the Title Page under "Inventors", after "Satou," insert --Masatoshi Takeshita--.

On the Title Page under "Inventors", "both" should be --all--.

On the Title Page under "U.S. Patent Documents" reference 3,043,028, "Henry" should be --Merry--.

Signed and Sealed this

Twenty-eighth Day of September, 1993

Bruce Lehman

*Attest:*

BRUCE LEHMAN

*Attesting Officer*

*Commissioner of Patents and Trademarks*